US008350478B2

(12) United States Patent
Ito et al.

(10) Patent No.: US 8,350,478 B2
(45) Date of Patent: Jan. 8, 2013

(54) VEHICLE DISCHARGE LAMP

(75) Inventors: Toru Ito, Shizuoka (JP); Toshiaki Tsuda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/309,781

(22) Filed: Dec. 2, 2011

(65) Prior Publication Data

US 2012/0139414 A1 Jun. 7, 2012

(30) Foreign Application Priority Data

Dec. 2, 2010 (JP) ..... 2010-269446

(51) Int. Cl.
*H01J 17/16* (2006.01)

(52) U.S. Cl. ..... 313/634; 313/623

(58) Field of Classification Search ..... 313/25–27, 313/111–117, 317, 318.01–318.09, 483–493, 313/567–577, 623, 627–643; 439/615, 739; 445/22, 24, 26, 29

See application file for complete search history.

(56) References Cited

U.S. PATENT DOCUMENTS

2006/0076894 A1 4/2006 Ansems et al.
2007/0018582 A1 1/2007 Tsuda et al.

FOREIGN PATENT DOCUMENTS

EP 2355130 A2 8/2011
JP 2007-250225 A 9/2007

OTHER PUBLICATIONS

European Extended Search Report dated Nov. 8, 2012 issued by the European Patent Office in corresponding European Patent Application No. 11191698.7.

*Primary Examiner* — Mariceli Santiago
*Assistant Examiner* — Donald Raleigh
(74) *Attorney, Agent, or Firm* — Sughrue Mion, PLLC

(57) ABSTRACT

A vehicle discharge lamp includes: an arc tube including a light emitter, a cathode side fine tube and an anode side fine tube; a cathode side connecting rod; an anode side connecting rod; a cathode side electrode and an anode side electrode disposed within the arc tube. The anode side fine tube includes an expansion portion and an insertion portion formed continuously with the expansion portion, a portion of the anode side electrode is situated within the expansion portion with a clearance, the expansion portion includes a uniform diameter portion with its inside diameter set uniform in an anode side electrode's axial direction, the light emitter includes a flat portion with its axial direction set coincident with the anode side electrode's axial direction, and an inside diameter of the uniform diameter portion is set larger than that of the insertion portion and smaller than that of the flat portion.

4 Claims, 4 Drawing Sheets

*FIG. 4A*

TABLE 1

| INITIAL CHARACTERISTIC | | C/D RATIO | | | | | |
|---|---|---|---|---|---|---|---|
| | | 1.0 | 1.1 | 1.2 | 1.3 | 1.4 | 1.5 |
| A/B RATIO | 0.8 | 3300 | 3262 | 3218 | 3154 | 3090 | 2990 |
| | 0.9 | 3285 | 3252 | 3208 | 3149 | 3085 | 2984 |
| | 1.0 | 3270 | 3236 | 3190 | 3137 | 3076 | 2976 |
| | 1.1 | 3250 | 3213 | 3165 | 3118 | 3062 | 2962 |
| | 1.2 | 3231 | 3192 | 3145 | 3099 | 3043 | 2938 |
| | 1.3 | 3206 | 3169 | 3117 | 3070 | 3006 | 2910 |
| | 1.4 | 3180 | 3136 | 3085 | 3017 | 2943 | 2866 |

LUMINOUS FLUX VALUE (lm)

*FIG. 4B*

TABLE 2

| LIFE PERFORMANCE | | C/D RATIO | | | | | |
|---|---|---|---|---|---|---|---|
| | | 1.0 | 1.1 | 1.2 | 1.3 | 1.4 | 1.5 |
| A/B RATIO | 0.8 | CRACK | CRACK | CRACK | CRACK | CRACK | CRACK |
| | 0.9 | CRACK | CRACK | CRACK | CRACK | CRACK | CRACK |
| | 1.0 | CRACK | CRACK | 95.1 | 94.7 | 93.2 | 91.0 |
| | 1.1 | CRACK | CRACK | 93.9 | 92.7 | 90.8 | 88.6 |
| | 1.2 | CRACK | CRACK | 92.0 | 90.1 | 88.0 | 85.8 |
| | 1.3 | CRACK | CRACK | 86.9 | 84.5 | 82.0 | 80.2 |
| | 1.4 | CRACK | CRACK | 78.9 | 77.0 | 74.7 | 79.9 |

LUMINOUS FLUX MAINTAINING RATIO (%)

VEHICLE DISCHARGE LAMP

This application claims priority from Japanese Patent Application No. 2010-269446, filed on Dec. 2, 2010, the entire contents of which are hereby incorporated by reference.

FIELD OF THE INVENTION

The present disclosure relates to a discharge lamp for use in a vehicle. Specifically, the present disclosure relates to a technology for preventing generation of cracks in an anode side fine tube of a vehicle discharge lamp to secure the proper discharge property thereof by forming an expansion portion of a given inside diameter in a light emitting side end section of the anode side fine tube.

DESCRIPTION OF RELATED ART

A vehicle headlamp, differently from an ordinary lamp, requires precise light distribution control and, therefore, it must have a light emitting shape which is uniform, bar-like and provides a high shading ratio. Since an incandescent lamp and a halogen lamp have such properties, they are widely used as the light source of the vehicle headlamp.

On the other hand, in a vehicle headlamp using a discharge lamp as the light source thereof, the discharge lamp provides high luminous flux and luminance when compared with the incandescent lamp and halogen lamp and also has a longer life than the incandescent lamp and halogen lamp.

Thus, since the discharge lamp has higher luminance and longer life than the incandescent lamp and halogen lamp, recently, as a vehicle headlamp, there has been popularly used a headlamp including a discharge lamp.

Generally, in the discharge lamp, an arc tube including a pair of electrodes and containing gas such as inert gas or halide therein is disposed in an interior portion of an outer tube used to protect the arc tube and stabilize the temperature thereof. The arc tube is constituted of a light emitter where discharge is carried out therein and a pair of fine tubes respectively disposed on the mutual opposite sides with the light emitter between the pair of fine tune portions. The light emitter is a portion in which, when discharge is carried out, an arc is generated and also which is formed larger than a diameter of the fine tubes.

In the discharge lamp, high voltage pulses are applied to the electrodes and discharge is carried out in the light emitter of the arc tube, thereby starting the turn on of the discharge lamp.

Such discharge lamp, when compared with a discharge lamp for general illumination, must secure a rapid rising characteristic after it is actuated and thus, in order to secure such rapid rising characteristic, just after the lamp is turned on (just after it is actuated), there are supplied thereto electric power several times higher than the electric power that is necessary in the steady-time turn-on state thereof.

The turn-on system of the discharge lamp includes an alternate current turn-on system and a direct current turn-on system (see, for example, Japanese Patent Publication JP-A-2007-250225). In the discharge lamp of the direct current turn-on system, there are used two electrodes which respectively function as a cathode side electrode and an anode side electrode.

In the discharge lamp of the direct current turn-on system, it is not necessary to switch the polarity of the electrodes. Therefore, when compared with the discharge lamp of the alternating current turn-on system in which the cathode side and anode side electrodes respectively require their exclusive designs, there can be eliminated a circuit necessary for switching the polarity and thus the direct current turn-on system discharge lamp is advantageous in that the cost and size thereof can be reduced.

The discharge lamp of the direct current turn-on system has a characteristic that the anode side electrode for receiving electrons has higher temperature and generates a larger quantity of heat than the cathode side electrode for discharging electrons. Also, as described above, since, in order to secure the rapidity of the rising characteristic, just after the lamp is turned on, there is supplied power several times higher than the power necessary in the steady-state time, the temperature of the anode side electrode rises further and thus the quantity of heat generated thereby increases further.

Thus, in the direct current turn-on system discharge lamp, in order to prevent it from being molten or deformed due to the heat of the anode side electrode, the anode side electrode is formed to have a thickness several times larger than that of the cathode side electrode.

However, as described above, in the direct current turn-on system discharge lamp, since the anode side electrode has a thickness several times larger than that of the cathode side electrode, the distance between an outer peripheral surface of the anode side electrode and an inner peripheral surface of the fine tube is close and thus, due to transmission of heat from the anode side electrode, the fine tube is easy to produce cracks.

The cracks of the fine tube cause a leak phenomenon to reduce an internal pressure of the arc tube, thereby failing to secure a proper discharge property and thus resulting in the poor turn-on of the lamp.

Therefore, there is proposed a method in which the inside diameter of the whole of the fine tubes is increased and thus the distance between the anode side electrode and the fine tube is increased to thereby prevent the generation of the cracks.

However, in this case, there is a fear that most of the halide filled into the interior portion of the arc tube can invade into the interior portion of the fine tube and thus the quantity of the halide staying in the light emitter can be reduced, thereby lowering the light emitting efficiency thereof. Also, if the quantity of the halide to be charged into the arc tube is increased in order to increase the quantity of the halide staying in the light emitter, due to such halide, the arc tube is easy to corrode.

Also, when the inside diameter of the whole of the fine tubes is increased, a heat capacity of the fine tubes is increased, thereby raising a possibility that the light emitting efficiency and rising characteristic of the discharge lamp can be lowered.

SUMMARY OF INVENTION

Illustrative aspects of the present invention provide a vehicle discharge lamp for preventing the generation of cracks and securing a proper discharge property.

According to a first aspect of the invention, A vehicle discharge lamp for emitting light according to a direct current turn-on system, comprising: an arc tube including a light emitter, and a cathode side fine tube and an anode side fine tube respectively disposed continuously with the light emitter on their mutual opposite sides with the light emitter between the cathode side fine tube and the anode side fine tube; a cathode side connecting rod having a portion disposed within the cathode side fine tube; an anode side connecting rod having a portion disposed within the anode side fine tube; a cathode side electrode disposed within the arc tube, with one end thereof in an axial direction being connected to one end of the cathode side connecting rod in an axial direction of the cathode side connecting rod; and an anode side electrode disposed within the arc tube, with one end thereof in an axial direction being connected to one end of the anode side connecting rod in an axial direction of the anode side connecting rod, wherein: the anode side fine tube includes an expansion portion formed in an end portion thereof existing on the light emitter side and an insertion portion formed continuously with the expansion portion and capable of receiving the anode side connecting rod therein; a portion of the anode side electrode is situated within the expansion portion, and a clearance is provided between an inner peripheral surface of the expansion portion and an outer peripheral surface of the anode side electrode; the expansion portion includes a uniform diameter portion in which an inside diameter thereof is set uniform in an axial direction of the anode side electrode; the light emitter includes a cylindrical-shaped flat portion in which a axial direction thereof is set coincident with the axial direction of the anode side electrode; and an inside diameter of the uniform diameter portion is set larger than an inside diameter of the insertion portion and smaller than an inside diameter of the flat portion.

Other aspects and advantages of the invention will be apparent from the following description, the drawings and the claims.

BRIEF DESCRIPTION OF THE DRAWINGS

FIGS. 4A and 4B are graphic representations of the measured results on the initial characteristic and life performance of the discharge lamp.

DETAILED DESCRIPTION OF EXEMPLARY EMBODIMENTS

Now, description will be given below of the best mode for carrying out a vehicle discharge lamp according to the invention with reference to the accompanying drawings. The vehicle discharge lamp is provided in a vehicle headlamp.

Two vehicle headlamps 1 are respectively mounted on the right and left end sides of the front end portion of a vehicle body.

Figure 1:
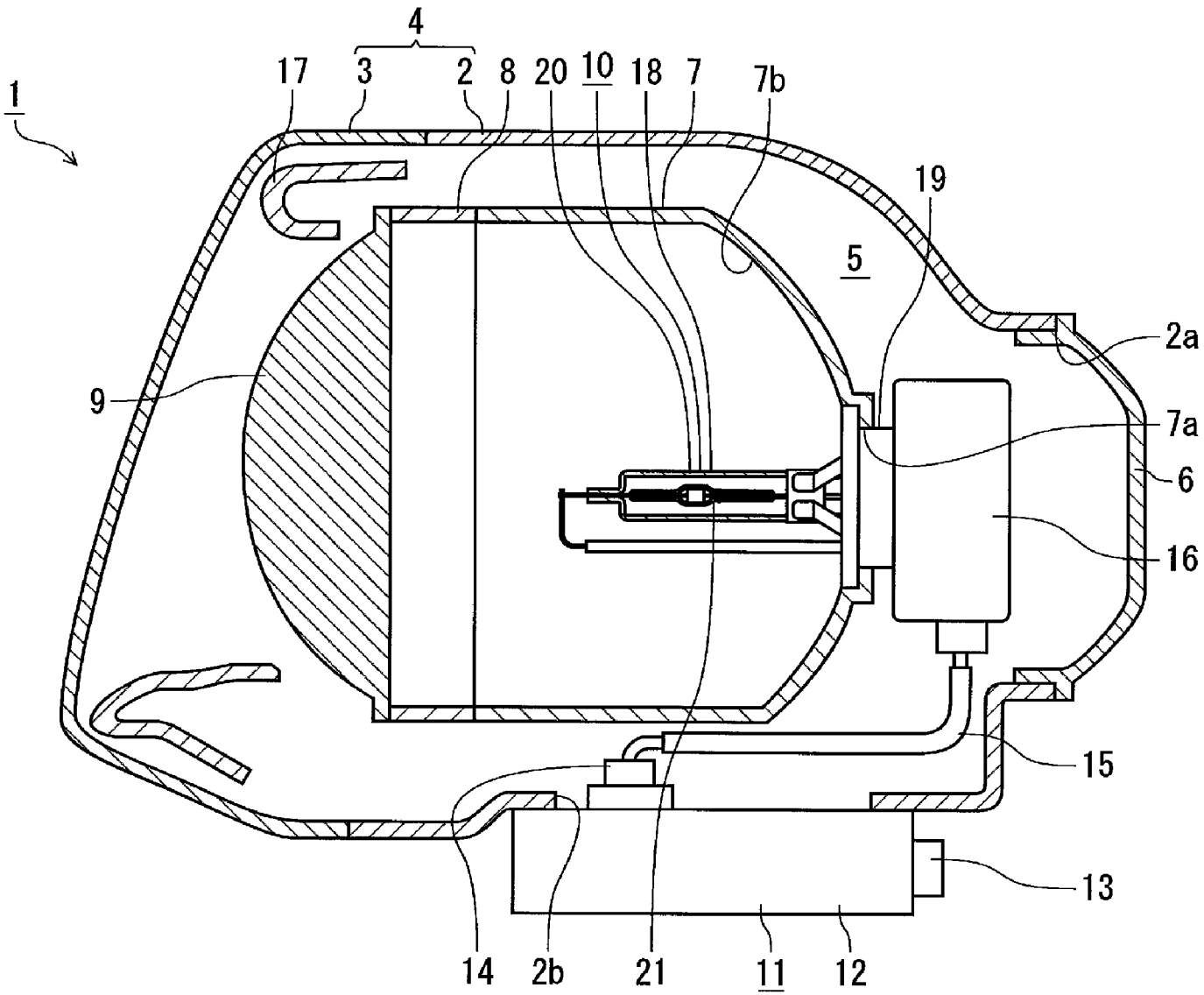
FIG. 1 is a schematic section view of a vehicle headlamp according to the invention.

Each vehicle headlamp 1, as shown in FIG. 1, includes a lamp housing 2 having a recess portion opened forwardly and a cover 3 for covering the open surface of the lamp housing 2, while the lamp housing 2 and cover 3 constitute a lamp outer box 4. An internal space of the lamp outer box 4 is formed as a lamp chamber 5.

The lamp housing 2 includes an insertion hole 2*a* so formed in its rear end portion as to penetrate the lamp housing 2 in its longitudinal direction, while the insertion hole 2*a* is closed by a back cover 6. In a lower end portion of the lamp housing 2, there is formed a location hole 2*b* which penetrates the lamp housing 2 vertically.

Within the lamp chamber 5, a reflector 7 is inclinably supported by an optical axis adjusting mechanism (not shown). The reflector 7 includes a mounting hole 7*a* so formed in its rear end portion as to penetrate the reflector 7 in its longitudinal direction. An inner surface of the reflector 7 is formed as a reflecting surface 7*b*.

A lens holder 8 is mounted on a front end portion of the reflector 7 and a projection lens 9 is mounted on a front end portion of the lens holder 8.

A discharge lamp (vehicle discharge lamp) 10 is mounted in the mounting hole 7*a* of the reflector 7 in such a manner that the discharge lamp 10 extends in the longitudinal direction.

A discharge lamp turn-on device 11 is mounted in the location hole 2*b* of the lamp housing 2. The discharge lamp turn-on device 11 is constituted of a case member 12 and a turn-on circuit (not shown) stored within the case member 12. The case member 12 includes an input side connector 13 provided on its outer peripheral surface and an output side connector 14 provided on its upper surface.

The input side connector 13 is connected to a power supply circuit (not shown) by a connecting code (not shown).

The output side connector 14 is connected through a feed code 15 to a starter device 16 which is connected to a socket (to be discussed later) of the discharge lamp 10.

To turn on (start) the discharge lamp 10, a supply voltage of the power supply circuit may be raised by the turn-on circuit of the turn-on device 11 and high voltage pulses may be applied to the discharge lamp 10 through the feed code 15 and starter device 16 to thereby start discharge. As a turn-on system for the discharge lamp 10, there is used a direct current turn-on system.

On a front end portion of the lamp chamber 5, there is disposed an extension 17 used to partially shield the respective parts disposed within the lamp chamber 5. In the lamp chamber 5, there is provided a shade (not shown) for shading part of light emitted from the discharge lamp 10.

Figure 2:
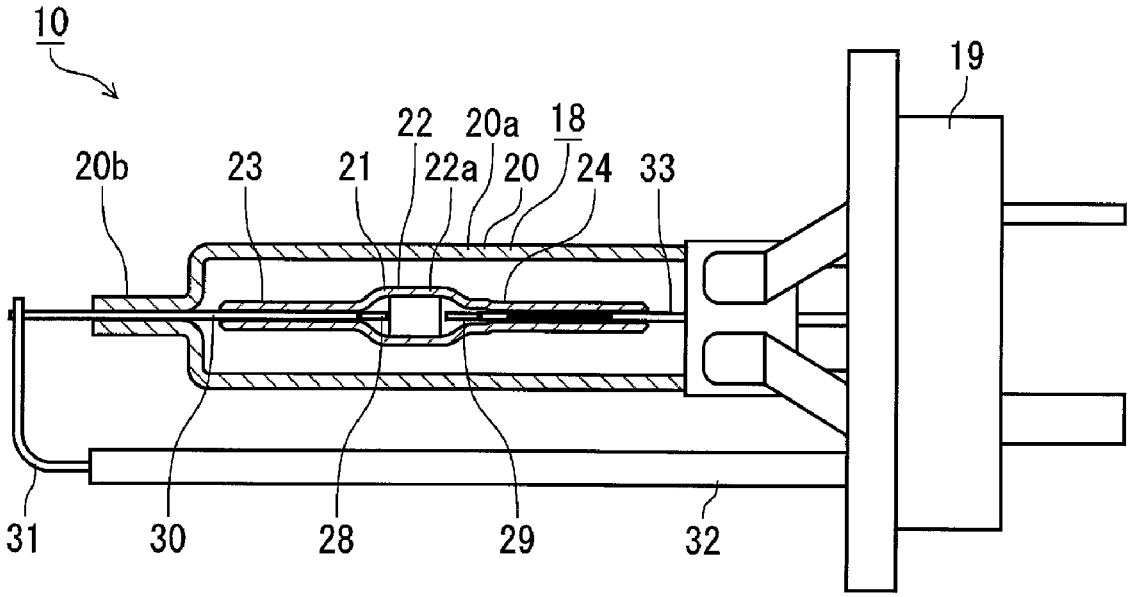
FIG. 2 is a partially sectional enlarged side view of a discharge lamp included in the vehicle head lamp according to the invention.

The discharge lamp 10 can be structured by connecting a main body 18 to a socket 19 (see FIG. 2).

The main body 18 includes an outer tube 20 and an arc tube 21 disposed within the outer tube 20.

The outer tube 20 is an integral body constituted of a closing portion 20*a* for closing the arc tube 21 or the like and a hold portion 20*b* projected forwardly from a front end portion of the closing portion 20*a*.

The arc tube 21 is made of ceramics such as alumina or the like and includes a light emitter 22, and a cathode side fine tube 23 and an anode side fine tube 24 respectively formed continuously with front and rear ends of the light emitter 22. The cathode side fine tube 23 and anode side fine tube 24 are respectively formed to have a substantially cylindrical shape extending in the longitudinal direction, while their outside diameters are respectively set smaller than the outside diameter of the light emitter 22.

Within the light emitter 22 and inside the end portions of the cathode side fine tube 23 and anode side fine tube 24 on their respective light emitter 22 side, there are included halide and an inert gas such as xenon or argon. The middle section of the light emitter 22 in its longitudinal direction is formed as a flat portion 22*a* having a substantially cylindrical shape extending in the longitudinal direction.

Figure 3:
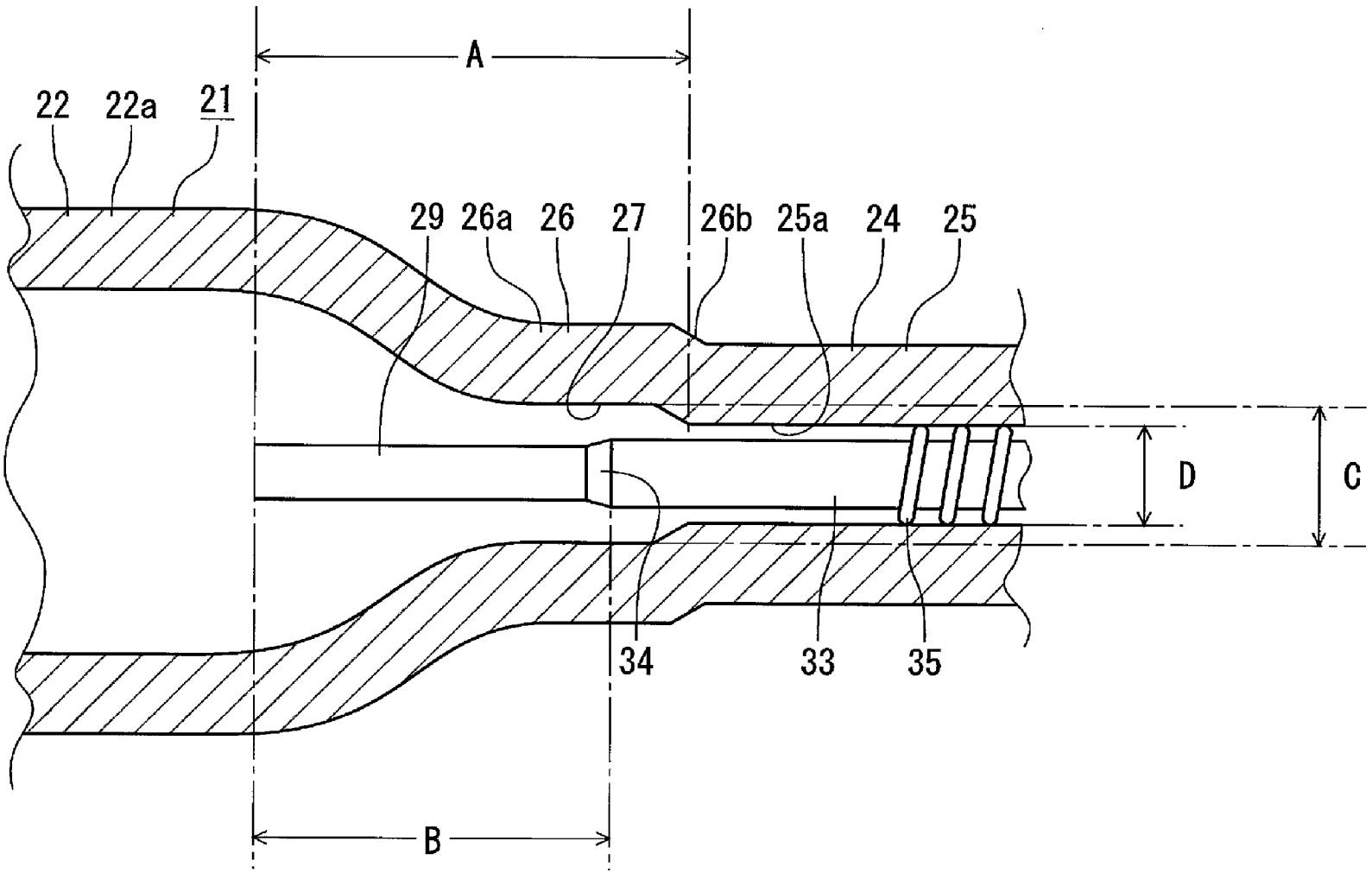
FIG. 3 is an enlarged section view of a portion of the discharge lamp.

The anode side fine tube 24, as shown in FIG. 3, includes an insertion portion 25 existing on the rear side thereof and an expansion portion 26 formed continuously with the front end of the insertion portion 25, while the front end of the expansion portion 26 is formed continuously with the rear end of the light emitter 22.

The insertion portion 25 has a cylindrical shape long in the longitudinal direction.

The expansion portion 26 is formed as the front end section of the anode side fine tube 24 and has a thickness equal to the thickness of the insertion portion 25 and light emitter 22. The inner peripheral surface 27 of the expansion portion 26 is situated outwardly of the inner peripheral surface 25*a* of the insertion portion 25, while the inside diameter of the expansion portion 26 is set larger than the inside diameter of the insertion portion 25.

The expansion portion 26, except for its rear end part, is formed as a uniform diameter section 26*a* the inside diameter of which is set uniform, while the rear end part of the expansion portion 26 is formed as a variable diameter section 26*b* in which its inside diameter decreases as it goes backwardly. The inside diameter of the front end of the variable diameter section 26*b* is set equal to the inside diameter of the uniform diameter section 26*a*, while the inside diameter of the rear end thereof is set equal to the inside diameter of the insertion portion 25.

Here, in the above example, the thickness of the expansion portion 26 is set equal to the thickness of the insertion portion 25 and light emitter 22. However, the thickness of the expansion portion 26 may also be set larger than the thickness of the insertion portion 25 and light emitter 22.

Within the arc tube 21, for example, there are disposed a cathode side electrode 28 and an anode side electrode 29 respectively formed long in the longitudinal direction of metal material such as tungsten and spaced from each other in the longitudinal direction. Therefore, in the discharge lamp 10, its front end side serves as the cathode side and its rear end side serves as the anode side.

The cathode side electrode 28 and anode side electrode 29 are respectively in part situated within the light emitter 22. For example, the cathode side electrode 28 is formed to have a needle-like shape of a small diameter, whereas the anode side electrode 29 is formed to have a thick rod-like shape with its outside diameter set larger than the outside diameter of the cathode side electrode 28.

Here, in the above example, the cathode side electrode 28 is situated on the front side and the anode side electrode 29 is situated on the rear side. However, reversely, the cathode side electrode 28 may also be situated on the rear side and the anode side electrode 29 may be situated on the front side, whereby the front side can serve as the anode side and the rear side can serve as the cathode side.

To the front end of the cathode side electrode 28, there is connected a cathode side connecting rod 30, for example, by welding. The cathode side connecting rod 30 is made of metal material such as molybdenum, and includes a portion which is projected forwardly from the cathode side fine tube 23 of the arc tube 21, is penetrated through the hold portion 20*b* and is projected to the outside of the outer tube 20. To the portion of the cathode side connecting portion 30 projected to the outside of the outer tube 20, there is connected a first conductor 31. A portion of the first conductor 31 is bent at an angle of 90° and is situated downwardly of the outer tube 20, while its rear end portion is connected to a first connecting terminal (not shown) provided on the socket 19.

Such portion of the cathode side connecting rod 30 as is situated within the cathode side fine tube 23 is sealed in the front end portion of the cathode side fine tube 23, for example, by frit glass (low melting glass).

On such portion of the first conductor 31 as is situated downwardly of the outer tube 20, there is mounted an insulation sleeve 32.

To the rear end of the anode side electrode 29, for example, there is connected an anode side connecting rod 33 by welding. The welded portion between the anode side electrode 29 and anode side connecting rod 33 is called a welded portion 34 as shown in FIG. 3.

The anode side connecting rod 33 is made of metal material such as molybdenum. The anode side connecting rod 33, except for its rear end portion, is situated within the anode side fine tube 24, while the rear end portion is projected backwardly from the anode side fine tube 24. To the rear end portion of the anode side connecting rod 33, there is connected a second conductor (not shown), while the rear end portion of the second conductor is connected to a second connecting terminal (not shown) provided on the socket 19.

The front end portion of the anode side connecting rod 33 and a substantially rear half section of the anode side electrode 29 are situated within the expansion portion 26. The outer peripheral surface of the front end portion of the anode side connecting rod 33 and the outer peripheral surface of the substantially rear half section of the anode side electrode 29 provide a clearance with respect to the inner peripheral surface 27 of the expansion portion 26.

Such portion of the anode side connecting rod 33 as is situated within the anode side fine tube 24 is sealed in the rear end portion of the anode side fine tube 24, for example, by frit glass.

On such portion of the anode side connecting rod 33 as is situated within the anode side fine tube 24, there is wound a coil 35 made of metal material such as molybdenum. Therefore, the coil 35 is disposed within the anode side fine tube 24.

In the discharge lamp 10, as a shroud gas, for example, an inert gas such as an argon gas and a nitrogen gas are filled in a space existing outside the arc tube 21 within the outer tube 20.

Also, within the light emitter 22, there is filled halide such as iodide together with an inert gas such as a xenon gas and an argon gas.

In the discharge lamp 10, as described above, as the turn-on system, there is used the direct current turn-on system in which high voltage pulses are applied to the anode side electrode 29 to start the lamp (emit light) and the temperature on the anode side electrode 29 side becomes higher than the temperature on the cathode side electrode 28 side.

As described above, in the discharge lamp 10, since the inside diameter of the uniform diameter section 26*a* of the expansion portion 26 formed in the anode side fine tube 24 is set larger than the inside diameter of the insertion portion 25, the heat of the anode side electrode 29 providing higher temperature is difficult to be transmitted to the anode side fine tube 24, thereby being able to prevent generation of cracks in the arc tube 21, especially in the anode side fine tube 24.

Also, since generation of cracks in the anode side fine tube 24 is prevented and thus a leak phenomenon is prevented, the reduced inner pressure of the arc tube 21 can be prevented, thereby being able to secure a proper discharge property.

Further, since generation of cracks can be prevented without increasing the inside diameter of the whole of the anode side fine tube 24, the invasion of the halide filled in the arc tube 21 into the anode side fine tube 24 can be prevented, thereby being able to prevent the lowered light emission efficiency of the lamp. And, the prevention of the halide into the anode side fine tube 24 can eliminate the need to increase the filling amount of the halide into the arc tube 21 in order to increase the quantity of the halide to be stored in the light emitter 21, thereby being able to prevent the arc tube 21 from being corroded due to such halide.

Still further, since the inside diameter of the whole of the anode side fine tube 24 is not increased, the heat capacity of the anode side fine tube 24 increases little, thereby being able to prevent the lowered light emission efficiency and the deteriorated rising property.

In the discharge lamp 10, the dimensions of the respective composing parts thereof were changed and the influences of such dimension changes on the initial characteristic and life performance of the lamp were measured. Now, description will be given below of the measured results (see FIGS. 4A and 4B).

A dimension B shown in FIGS. 4A and 4B expresses the distance from such one end (front end) of the anode side electrode 29 as is not connected to the anode side connecting rod 33 to such the other end (front end) of the anode side connecting rod 33 as is connected to the anode side electrode 29 (see FIG. 3). A dimension A shown in FIGS. 4A and 4B expresses the distance from such one end (front end) of the anode side electrode 29 as is not connected to the anode side connecting rod 33 to the connecting point between the expansion portion 26 and insertion portion 25 (see FIG. 3).

A dimension C shown in FIGS. 4A and 4B designates the inside diameter of the uniform diameter part 26*a* of the expansion portion 26 (see FIG. 3), while a dimension D shown in FIGS. 4A and 4B expresses the inside diameter of the insertion portion 25 (see FIG. 3).

Table 1 illustrated in the upper stage of FIG. 4A shows the measured results of the influences on the initial characteristic.

In Table 1, there is shown the relationship between a ratio A/B and a ratio C/D with respect to the initial characteristic. Numeric values shown in Table 1 express the luminous flux values (lm) of the light to be emitted from the light emitter of a discharge lamp when the values of the ratio A/B and ratio C/D are varied.

The luminous flux value must be 3000 lm or more. And, as the ratio A/B and ratio C/D both increase, the heat capacity of the anode side fine tube 24 increases to thereby reduce the luminous flux value.

As shown in Table 1, in a range surrounded by a thick frame where the luminous flux value is set to be 3000 lm or more, there can be obtained a proper initial characteristic, whereas, for the ratio C/D of 1.5 or more, the luminous flux value is found less than 3000 ml.

Table 2 shows the relationship between ratio A/B and ratio C/D with respect to the life performance. In the case of numeric values shown in Table 2, when the values of the ratio A/B and ratio C/D are varied, the luminous flux value L1 according to the initial characteristic of the discharge lamp and the luminous flux value L2 after the discharge lamp is turned on for 1500 hours are measured, and the ratio of the luminous flux value L2 to the luminous flux value L1 is expressed as a luminous flux maintaining ratio (%). In Table 2, the term "crack" shows that, within 1500 hours after the turn-on of the discharge lamp, a crack has been produced in the arc tube.

The luminous flux maintaining ratio must be 80% or more. And, as the ratio A/B and ratio C/D both increase, the quantity of invasion of halide into the expansion portion increases to thereby reduce the luminous flux maintaining ratio. Also, as the ratio A/B and ratio C/D both decrease, the crack is easy to occur.

As shown in FIG. 2, in a range surrounded by a thick frame where no crack is generated and the luminous flux maintaining ratio is 80 or higher, there is obtained a proper life performance.

Of the ranges of Tables 1 and 2 respectively surrounded by the thick frames, the ranges contained in both table are ranges where proper initial characteristic and proper life performance can be secured. Such ranges include the range where the ratio C/D is 1.2 to 1.4 and the range where the ratio A/B is 1.0 to 1.3.

Therefore, when the ratio C/D is set in the range of 1.2 to 1.4, since the proper initial characteristic and proper life performance can be secured, generation of cracks can be prevented and proper discharge property can be secured.

Also, when the ratio A/B is set in the range of 1.0 to 1.3, since the proper initial characteristic and proper life performance can be secured, generation of cracks can be prevented and proper discharge property can be secured.

Further, when the ratio C/D is set in the range of 1.2 to 1.4 and also the ratio A/B is set in the range of 1.0 to 1.3, since the proper initial characteristic and proper life performance can be secured, generation of cracks can be prevented and proper discharge property can be secured.

The shapes and structures of the respective composing parts shown in the above-mentioned best mode for carrying out the invention are just examples of specific parts used to carry out the invention. Therefore, the technological range of the invention must not be limited to such shapes and structures.

What is claimed is:

1. A vehicle discharge lamp for emitting light according to a direct current turn-on system, comprising:

an arc tube including a light emitter, and a cathode side fine tube and an anode side fine tube respectively disposed continuously with the light emitter on their mutual opposite sides with the light emitter between the cathode side fine tube and the anode side fine tube;

a cathode side connecting rod having a portion disposed within the cathode side fine tube;

an anode side connecting rod having a portion disposed within the anode side fine tube;

a cathode side electrode disposed within the arc tube, with one end thereof in an axial direction being connected to one end of the cathode side connecting rod in an axial direction of the cathode side connecting rod; and an anode side electrode disposed within the arc tube, with one end thereof in an axial direction being connected to one end of the anode side connecting rod in an axial direction of the anode side connecting rod, wherein:

the anode side fine tube includes an expansion portion formed in an end portion thereof existing on the light emitter side and an insertion portion formed continuously with the expansion portion and capable of receiving the anode side connecting rod therein;

a portion of the anode side electrode is situated within the expansion portion, and a clearance is provided between an inner peripheral surface of the expansion portion and an outer peripheral surface of the anode side electrode;

the expansion portion includes a uniform diameter portion in which an inside diameter thereof is set uniform in an axial direction of the anode side electrode;

the light emitter includes a cylindrical-shaped flat portion in which a axial direction thereof is set coincident with the axial direction of the anode side electrode; and an inside diameter of the uniform diameter portion is set larger than an inside diameter of the insertion portion and smaller than an inside diameter of the flat portion.

2. The vehicle discharge lamp according to claim 1, wherein the inside diameter of the uniform diameter portion is set 1.2 to 1.4 times larger than the inside diameter of the insertion portion.

3. The vehicle discharge lamp according to claim 1, wherein a distance from one end of the anode side electrode that is not connected to the anode side connecting rod to a connecting point between the expansion portion and the insertion portion is set 1.0 to 1.3 times larger than a distance from the one end of the anode side electrode that is not connected to the anode side connecting rod to the other end of the anode side connecting rod that is connected to the anode side electrode.

4. The vehicle discharge lamp according to claim 2, wherein a distance from one end of the anode side electrode that is not connected to the anode side connecting rod to a connecting point between the expansion portion and the insertion portion is set 1.0 to 1.3 times larger than a distance from the one end of the anode side electrode that is not connected to the anode side connecting rod to the other end of the anode side connecting rod that is connected to the anode side electrode.

* * * * *